US006425845B1

(12) United States Patent
Varner

(10) Patent No.: US 6,425,845 B1
(45) Date of Patent: Jul. 30, 2002

(54) ABDOMINAL BUTTOCKS AND OTHER MUSCLE GROUPS EXERCISE DEVICE

(76) Inventor: David Varner, 2598 Cricket Ct., Marietta, GA (US) 30064

( * ) Notice: Subject to any disclaimer, the term of this patent is extended or adjusted under 35 U.S.C. 154(b) by 0 days.

(21) Appl. No.: 09/563,647

(22) Filed: May 2, 2000

(51) Int. Cl.[7] ..... A63B 21/00

(52) U.S. Cl. ..... 482/123; 482/907; 482/121; 482/113

(58) Field of Search ..... 482/121, 123, 482/129, 148, 904, 142, 130

(56) References Cited

U.S. PATENT DOCUMENTS 5,215,511 A * 6/1993 Cheng ..... 482/121

6,146,317 A * 11/2000 Prusick ..... 482/130

* cited by examiner

*Primary Examiner*—Jerome W. Donnelly
(74) *Attorney, Agent, or Firm*—Smith, Gambrell & Russell LLP; Herbert M. Hanegan; Dale Lischer

(57) ABSTRACT

An exercise device for specific isolation and development of abdominal, pelvic, shoulder, forearm and buttock muscle groups comprises a deformable spring-resistance which is closely retained against the user's lower abdominal and upper leg region. When the device is used in a horizontal position the user kneels on the frame and grasps the frame with the hands and performs a pelvic thrusting motion against the resistance means by use of the above-stated muscle groups.

14 Claims, 2 Drawing Sheets

ABDOMINAL BUTTOCKS AND OTHER MUSCLE GROUPS EXERCISE DEVICE

FIELD OF THE INVENTION

This invention is a resistance-based exercise device for beneficial workout and development of specific muscle groups, namely of the lower abdominal and buttocks musculature consisting of upper, lower and transverse abdominal muscles, gluteus maximus and upper leg muscles. Shoulders and latisimus dorsi are also toned and defined.

BACKGROUND OF THE INVENTION

In the world of fitness, exercise and body-building, the efficient development of abdominal muscles of the human body is particularly difficult. Because the abdominal muscles are not attached to any joint, traditional joint movement exercises have little or no effect on the abdominals. Exercises such as sit-ups or weight-loaded variations on sit-ups may indirectly involve the abdominal muscles but are inefficient because much of the exercise energy is dissipated in the joints and muscles attached to the joints such as hip flexors. Thus, the traditional exercises and machines designed to exercise abdominal muscles are inefficient and require long and laborious programs of rigorous exercise.

The abdominal muscles, consist of several muscle groups, all located in the midsection, just below the chest to the pubic bone. These include: rectus abdominis which is made up of upper, middle, and lower abdominals; transverse abdominis; and the obliques. The abdominals bring the ribs and the pelvis closer together.

The upper, middle and lower abdominals start near the middle of the sternum and run vertically to the lower part of the pelvis; they are responsible for flexing the vertebral column or helping curl the trunk when doing such activities as sit-ups or sitting up in bed. It is important to have strong abdominal muscles for most motions, including common day-to-day activities. These muscles help support the spine. Weak muscles also create greater pressure on the lower back and often cause lower back pain. Furthermore, weak muscles can create an unattractive physical appearance and result in loss of self esteem. Strong abdominal muscles, on the other hand, not only help in physical appearance and self esteem but also aid in physical activities such as running and other sports.

Sit-ups and similar exercises are often used by people attempting to strengthen the abdominal muscles. Unfortunately, many of these traditional abdominal exercises, such as the basic sit-up, involve the abdominal muscles mostly in a secondary role as a stabilizer. The bulk of the motion in these exercises is actually provided by the muscle group known as the hip flexors. For example, if a person performs sit-ups with his/her feet held down, the hip flexors, rather than the abdominal muscles may end up doing the majority of the work. This may lead to strong hip flexor muscles pulling down on the pelvis. Without strong lower abdominal muscles to counteract this downward pull this may result in a forward tilting pelvis rather than a balanced pelvis and potentially lead to lower back pain.

In addition, injuries may occur as a result of improper exercising techniques. For example, injuries often occur when a person incorrectly performs an exercise, such as the traditional sit-up in which a person lies back down on the floor with hands behind the head and then attempts to raise the trunk of the body in a "crunching" motion. Often times when doing traditional sit-ups a person will pull on the neck to aid in performing the movement, thus increasing the chances of a neck injury and decreasing the work of the abdominal muscles. Furthermore, when performing a traditional sit-up a person may not move the head neck and shoulder as a single unit or may incorrectly arch the back thereby leading to possible injury. In addition, due to the varying degrees of difficulty of moving the body through the range of the traditional sit-up, such as the difficulty in initially moving the body from the floor, people often use jerking type motions to perform a sit-up. Finally, traditional sit-ups are often painful to perform on a hard surface such as an uncarpeted floor. The present invention allows for an abdominal workout on such hard surfaces by providing a frame on which the person performs the exercise.

The present device allows for the exercising of the abdominal muscles by simple smooth motions which do not require jerking or the need to grab the head to move the upper body.

In an effort to provide for the efficient and easy exercise of muscles, including the abdominals, a variety of exercise devices have been developed, including powered machines, that selectively challenge different sets of body muscles. One area of exercise is directed to the abdominal muscle sets. One such device described in the patent literature as is described in U.S. Pat. No. 5,232,425 (Miller '425). The Miller patent teaches a device that involves direct, progressive resistance to the user over the field of action. This means that during movement over the inherent range of motion for the prior art device, that its resistance level increases linearly, as opposed to a preferred constant plus consistent resistance level throughout the device range of motion.

The prior art device lacks the mechanical features and architecture that can provide toning in the course of using the device's motion. This feature is made more evident by resort to FIGS. 11–17, of Miller on its one preferred embodiment. FIGS. 11 and 12 show the extreme postures effected in using the device upright and crouched. Looking to Miller's FIGS. 13, 15, and 16, an elastic band 124 is rigged over spaced-apart, opposing hood ends 120/134, so that user exertion on cross bands 40/41 results in a linearly increasing resistance as the finite length band 134 is extended.

As discussed above, there is a need for more efficient devices for exercise and development of abdominal musculature in addition to sporting and personal appearance aspects, in that the medical consequences of weak abdominal muscles are dangerously weak back and spinal erector muscle groups which oppose the frontal abdominal groups. Proper and efficient exercise oft he abdominal muscles will tend to require strengthening of back musculature, having both remedial and preventive beneficial effects relating to common lower back and spinal problems.

Because many prior art methods are oriented to controlled posture and tensioning with large weight-type devices, the devices can not be adapted to a portable use. In order to be made convenient, portable and accessible to a large market share, a new and more compact method was sought which might approach the efficiency of the prior art larger machines and retain many of the benefits newly developed for abdominal musculature exercise.

Previous attempts to provide abdominal exercise devices, such as U.S. Pat. No. 5,05,832, do not provide support for the device other than that supplied by the user. For instance, the device of that patent requires the device to be belted to the to the user's body by waistband 3. In addition, such devices are complicated, involving pulleys 8. The position oft he hands may be difficult for those with shoulder problems. Further, these devices encourage the pushing out of the abdominal muscles. cumbersome to use and is not readily adjustable to users of different sizes.

It is a principal object of the present invention to provide an abdominal and leg exercise device that can be used alternately for abdominal toning and leg muscle toning.

It is another object of the invention to provide an exercise device which incorporates a preferred constant resistance level feature occurring throughout the defined range of motion for the device user.

Due to the difficult nature of exercising the abdominal muscles, it is desirable to have a device which allows for the safe and convenient exercise of these muscles.

The current invention is designed to aid a person in putting the body in a position where the appropriate muscles are utilized.

Thus it is an object of the present invention to enable exercise of the abdominal musculature in an efficient and effective way while ensuring constant, proper body alignment thus avoiding twisting injuries.

It is a further object of the invention to provide a means of exercising the abdominal musculature that will isolate a major portion of the required user effort on the abdominal muscles being exercised, minimizing wasted motion.

A further object of the invention is to provide a means of exercising the upper leg muscle without the use of heavy weights or a separate device.

Another object of the invention is to provide a device that will correctively address lower back problems at the same time as exercising the abdominal musculature.

Another object of the invention is to provide a device that can be adjustable over a wide range for a variety of users of different heights and particular physical condition.

A further objective of the invention is to provide a simplified exercise method for development of the abdominal musculature that involves a minimum of separate parts and can be easily used by an unsophisticated purchaser.

Another objective is to reduce the effects of spinal lordosis.

Another objective of the invention is to provide a device which eliminates potential injury causing jerking motions of the user.

SUMMARY OF THE INVENTION

These and other objectives of the invention are accomplished by providing a device consisting primarily of a resilient spring-band of metal or resilient plastic configured so that one end of the leaf-spring shape is placed on the pubo-pelvic junction, upper leg or lower abdominal muscles to provide resistance exercise for the associated muscle groups. The spring can be deformed by means of pulling against a padded handle attached to the devices frame. The deformation and resistance of the spring may additionally be controlled by an adjustable device such as a spring, a hydraulic or air cylinder, or the like. The exercise is then repeated in sets as is common with development exercises of various kinds. The user may also place the device in a horizontal position on the floors such that the user is on "all fours" with the knees resting in padded cups. The user then pulls on the handles and moves the pelvis forward against the resistance means.

The present invention also eliminates injuries caused by jerking motions common with other abdominal exercises by providing a constant resistance to movement and stability to the user such that such jerking motions are unnecessary. Instead of having a starting position in which the user is lying back down, the current invention allows the exerciser to be in a stable "all fours" position when performing the exercise, thereby eliminating strain on the neck or shoulders.

When used in the horizontal position, the user places the frame feet down on the floor or other suitable surface. The user then mounts the frame by grasping the handles at the front of the machine with the hands and placing knees on knee pads at the rear of the frame such that the upper portion of the legs are perpendicular to the frame so that the user is in an "all fours" position. The pad member is adjusted so as to be positioned at the pubo-pelvic junction but resting against the medial pubis bone. From this "all fours" position the user flexes the pubic carriage forward and upward against the resistance and then relaxes back into the starting posture where the movement is immediately repeated. The abdominal area is thus exercised by rotating the resistance means through a range of motion at constant resistance.

DESCRIPTION OF THE PREFERRED EMBODIMENTS

Figure 1:
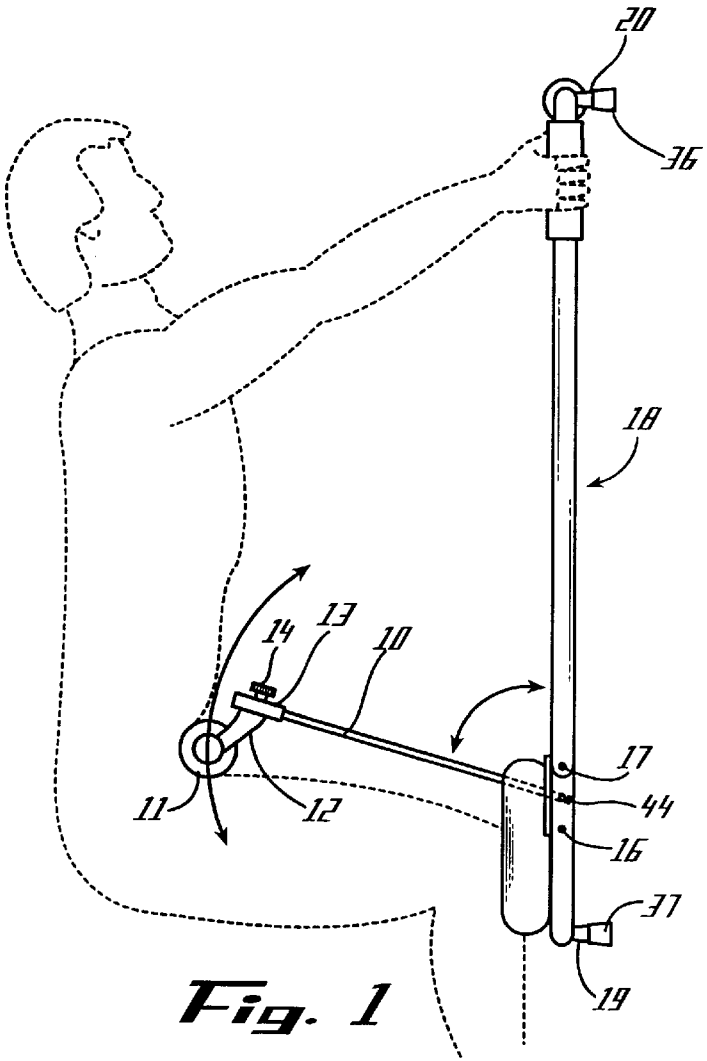
FIG. 1 is a side view of a human user of the exercise device showing the device in use.

According to FIG. 1 a first embodiment of the present invention is depicted in use in a side view which shows the resistance member 10 attached to frame 18 by spring anchor bracket 22 on one end and connected to pad member 13 near the other end. Pad member 13 has adjustment means 14 for adjusting the placement of pad member 13 on leaf spring 10 to obtain a comfortable placement on a human using the present device. Connector 12 connects pad 11 to pad member 13. Frame 18 has support legs 19 and 20 at opposing ends and may be pivoted at point 16 for storage. The spring mechanism pivots for storage, the feet are stationary. Stop pin 17 locates spring anchor bracket 22 on frame 18. Knee pads 15 attach to the lower portion of frame 18 and provide a comfortable contact point for the user's knees. The angle between resistance means 10 and frame 18 may be adjustable to adapt to the individual user's size and shape.

Figure 2:
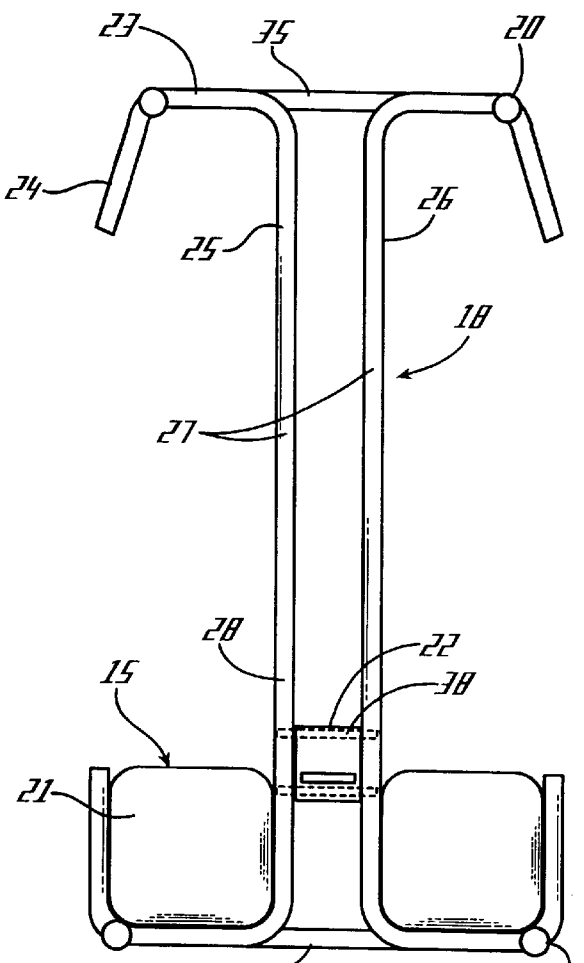
FIG. 2 is a perspective frontal view of the exercise device.

As shown in FIG. 2, frame 18 comprises opposed first and second C-shaped supports 25,26 such that the middle of the C-shape supports 25,26 form parallel support rails 27 approximately 4 inches apart. Frame 18 is preferably made of a light weight rigid support structure to stably support the user such as 1 inch metal tubing with a wall thickness of 1/16 inches. The frame is approximately 36 inches in the vertical direction and 26 inches in the lateral direction. Supports 25, 26 lie flat in a first plane except for handles 24 which may be tilted slightly towards the user for convenience of the user and ergonomic purposes. Handles 24 preferably have grip29, made of rubber, hard foam, or similar material which allows the user to firmly grasp handles 24 and prevent slippage of grip. Supports 25, 26 have a series of aligned location holes 28 along the parallel support rails 27 of the supports 25, 26 for insertion of bracket stop pin 17. Supports 25, 26 may have first section 39 and second section 41 pivotally connected at point 16 such that frame 18 is foldable for storage.

Cross support members 34, 35 are affixed to the top and rear of frame 18 at the base of the U-shaped portion of supports 25, 26 and extend perpendicular to supports rails 27. Cross support members 34, 35 have legs 19, 20 with feet 36, 37. Feet 36,37 of the cross support members 34, 35 contact the floor or other surface upon which the device is placed. Preferably the feet are placed at the outer corner of supports 25, 26 to provide for stability of frame 18 during use. Legs 19, 20 are approximately 3 inches in length so as to provide sufficient distance between the user's fingers and the contact surface on which the device is placed. Feet 36,37 have movement resistant bottoms, such as rubber or plastic to help prevent the device from sliding on the floor or other surface in which it is in contact. it will be noted that length of support legs 19, 20 may be adjustable, such as by a threaded screw such that the angle of the frame relative to the ground may be adjusted.

Knee pads 15 are preferably located on frame 18 about shoulder width apart. In a preferred embodiment knee pads are located on the outer side of the C-frame and are supported by a U-shaped curve at the bottom of the C-shaped supports 25,26 which surround pads 15 on three sides. Knee pads 15 have raised walls 21 on the front and sides, thus allowing for easy placement of the user's knee on the knee pad and providing forward and lateral support to the knee during use. In a preferred embodiment, knee pads 15 have a surface material preferably made of fabric covered foam which helps keep the knees from slipping. The interior of the knee pads are made of flexible foam to provide support for the knee and protection to the patella or kneecap. The knee pads are approximately 7 inches by 7 inches by 2 ½ inches.

In the embodiment shown in FIG. 2, anchor bracket 22 is located between parallel support rails 27 and has a receiving hole 38 for aligning with the location holes 28 of support rails for receiving stop pin 17. Stop pin 17, as shown in FIG. 1, may be inserted through the receiving hole 38 and location holes 28 thereby supporting anchor bracket 22 and holding it in position. Thus, the position of anchor bracket 22 and attached resistance member 10 may thus be adjusted along parallel support rails 27 of frame 18 by removal of stop pin 17. This allows for easy adjustment of resistance member 10 and pivot point 44.

As best seen in FIG. 1, resistance member 10 is pivotally connected to spring bracket 22 at a first end and pad member 13 at a second end. Connector 12 is attached to pad member 13 and extends to pad bar 43 on which pad 11 is affixed. Connector 12 is preferably curved towards the user. Pad 11 is preferably made of foam and covered in plastic for contact with the user. The adjustment means 14 allows for the movement of the pad member 13 along the resistance member 10 to adjust to the varying height of the users. The adjustment means 14 may be a screw which is tightened down on resistance member or other know means such as a slot and pin assembly or the like.

The resistance or tension of the resistance means may be adjusted according to the needs of the user. Two or three springs may be used for varying degrees of resistance. The exercise can be closely controlled by providing an adjustment to resistance means 14 which could easily be incorporated to vary the restraining strength of the shock between certain maximum and minimum forces. With such adjustment the device can accommodate progressive strengthening of the user and as the user advances in strength and development the tension of the device can be increased. The resistance varies over the range of motion, at the peak of motion the most resistance is present.

Figure 3:
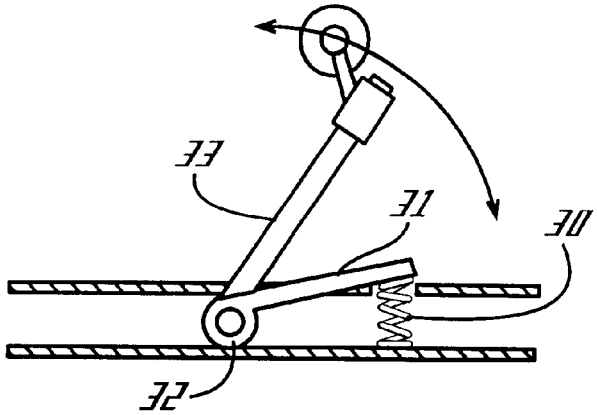
FIG. 3 is a side view of an alternate embodiment of the resistance mechanism of the present invention.
Figure 4:
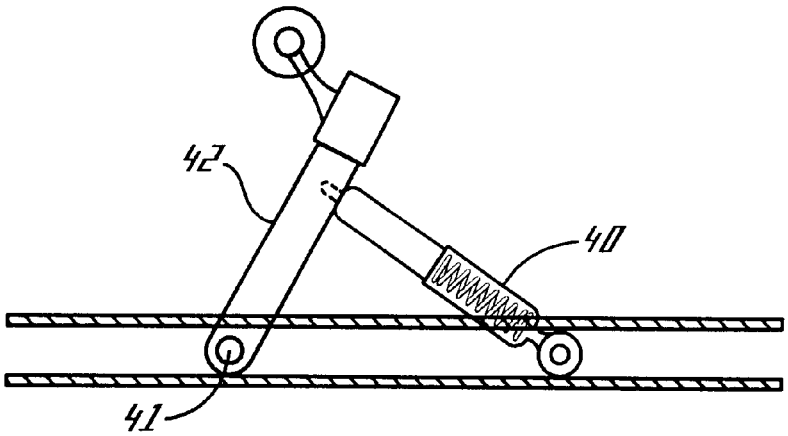
FIG. 4 is a side view of an alternate embodiment of the resistance mechanism of the present invention.
Figure 5:
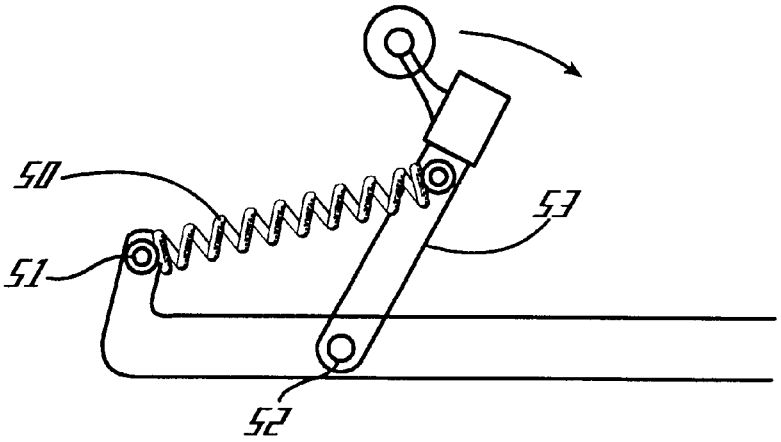
FIG. 5 is a side view of an alternate embodiment of the resistance mechanism of the present invention.

FIGS. 3, 4, and 5 depict alternate embodiments of resistance member 10. The resistance member may be constructed of a material which offers resistance to bending. Preferably the resistance member is a leaf spring and is manufactured from thin, flexible, steel. FIG. 3 depicts an alternate resistance means which comprises a spring 30 attached to, or abutting, the frame at one end and arm 31 at the other. Arm 31 is fixedly attached to arm 33 and rotates about pivot point 32 whereby the resistance spring 30 is compressed when the mechanism is used. FIG. 4 shows resistance means 40 which is a shock-style resistance connected to arm 42 at one end and to frame 18 at the other. FIG. 5 depicts another embodiment of the present invention wherein resistance spring 50 is stretched during the use of the device in order to provide resistance to movement of the pad. Spring 50 is attached at one end to frame 18 at point 51 and at the other end to arm 53. Arm 53 pivots on the frame at point 52.

The operation of the device will now be discussed. Frame 18 is placed on the floor. The user's posture and positioning when using the device can be seen in FIG. 1. FIG. 1 shows the user is in the initial vertical exercise position. The user places knees on knee pads 15 and grasps the form handles 24. The user is thus in a stable position in which to perform the exercise with his back parallel to the frame 18. The position pubo-pelvic 11 pad should be properly adjusted so that it rests against the pubo-pelvic bone of the user. The pad 11 located on the resistance member 10 is provided with resistance by resistance means, such as a leaf spring against the upward movement of the body, thereby causing the abdominal muscles to be exercised.

When used in the horizontal position, the user places the frame 18 feet down on the floor such that feet 36 and 37 contact the floor surface. The user then mounts the frame 18 by grasping the handles 24 and placing knees on knee pads 15 such that the upper portion of the legs are perpendicular to frame 18 so that the user is in an "all fours" position. The pad member 13 is adjusted so as to lightly rest against the pubo-pelvic bone. From this "all fours" position the user slowly thrusts the pelvis forward against resistance means. The user then moves his pelvic area forward against the pubo-pelvic pad 11 thereby pushing the pad member 13 and moving the resistance member 10 through an angular rotation about pivot point 44. The resistance member 10, which is a leaf spring in preferred embodiment show in FIG. 1 provides resistance to the movement thereby requiring the user to perform work which in turns exercises the abdominal, buttocks, shoulder and forearm muscles. The abdominal area is thus exercised by rotating the resistance member through a range of motion.

As the exercise device is used daily, the user will enjoy increased strength and definition of the abdominal muscles and will be able to operate the exercise device for longer intervals and increased multiples of the exercise in sets thus developing stamina. Because the exercise device is compact, light-weight, easy to use and portable, the user is encouraged to make regular use of the exercise device and realize the benefits in muscle tone and endurance as well as benefit to surrounding and balancing muscle groups such as lumbar and spinal erectors. As the device will have a variety of therapeutic uses, its ease of use and lack of need for intensive instruction of supervision will make it adaptable to use by semi-invalids, patients recovering from various injuries, and even persons suffering from limitations of strength and movement such as arthritis.

While the invention disclosed herein has been described by means of specific embodiments thereof, there are numerous modification and variations thereof which could be made by those skilled in the art. It is therefore to be understood that within the scope of the appended claims, the invention may be practiced otherwise than specifically described herein.

What is claimed is:

1. An exercise device comprising:

a frame, said frame including handles attached thereto for gripping by the hands of a user;

a knee support connected to said frame for contacting the knees of the user;

a resistance member pivotally connected to said frame for contacting the pubo-pelvic area of the user; and a resistance means included in said resistance member for providing resistance to pivoting of said resistance member such that the user can perform exercises by the motion of the abdominal and/or leg muscles against the pivotal resistance of said resistance means for cyclic pelvic thrusting, wherein said frame has a forward end and rear end with handles attached near said forward end, said knee support connected near said rear end and said resistance member connected between said handles and said rear end, and wherein said resistance means is based against motion towards said handles.

2. The exercise device of claim 1 wherein the connection of said resistance member to the frame is adjustable to accommodate the size of the user.

3. The exercise device of claim 1 wherein the resistance of said resistance means is adjustable.

4. The exercise device of claim 1 wherein said resistance means is a leaf spring.

5. The exercise device of claim 1 wherein said resistance means is a compression resistance spring comprising:

a bar pivotally connected to said frame and fixedly attached to said resistance member such that rotation of said resistance member rotates said bar; and a resistance spring attached at a first end to bar and at a second end to said frame such that rotation of bar compresses said resistance spring.

6. The exercise device of claim 1 wherein said resistance means is a shock resistance spring comprising a shock connected at a first end to said resistance member and at a second end to said frame such that rotation of said first member causes the shock to provide resistance to said rotation.

7. The exercise device of claim 1 wherein said resistance means is a stretch resistance spring attached at a first end to said resistance member and at a second end to said frame such that rotation of said resistance member causes the spring to stretch and provide resistance to said rotation.

8. An exercise device comprising:

a frame, said frame including handles attached thereto for gripping by the hands of a user;

a knee support connected to said frame for contacting the knees of the user;

a connector attached to said frame;

a resistance member pivotally attached to said connector and extending in a plane perpendicular to said frame;

a pad assembly attached to said resistance member, said pad assembly for contacting the pubo-pelvic area of the user such that the user can perform exercises by the motion of the abdominal and/or leg muscles against said resistance member, wherein said frame has a forward end and a rear end with handles attached near said forward end, said knee support connected near said rear end and said resistance member connected between said handles and said rear end, and wherein said resistance means is biased against motion towards said handles.

9. The exercise device of claim 1 wherein said frame is foldable about a pivot point to flatten the unit for storage.

10. The exercise device of claim 1 wherein said resistance member is connected to said frame by an anchor bracket.

11. The exercise device of claim 10 wherein the angle between said resistance member and said frame is adjustable.

12. The exercise device of claim 4 wherein said leaf spring is manufactured of metal.

13. The exercise device of claim 8 wherein said resistance member is manufactured of steel.

14. The exercise device of claim 4 wherein said leaf spring is manufactured from a material selected from the group consisting of resilient plastic, fiberglass, graphite, boron, carbon fiber or other flexible semi-rigid material.

* * * * *